US008596450B2

(12) United States Patent
Henry

(10) Patent No.: US 8,596,450 B2
(45) Date of Patent: Dec. 3, 2013

(54) SERVING ASSEMBLY

(75) Inventor: Louis Henry, New York, NY (US)

(73) Assignee: A2 Product Development, Inc., New York, NY (US)

( * ) Notice: Subject to any disclaimer, the term of this patent is extended or adjusted under 35 U.S.C. 154(b) by 0 days.

(21) Appl. No.: 13/427,492

(22) Filed: Mar. 22, 2012

(65) Prior Publication Data

US 2012/0241338 A1 Sep. 27, 2012

Related U.S. Application Data

(60) Provisional application No. 61/466,275, filed on Mar. 22, 2011.

(51) Int. Cl.
*B65D 77/00* (2006.01)

(52) U.S. Cl.
USPC ..... 206/216

(58) Field of Classification Search
USPC ..... 206/216, 217, 218, 223, 541, 564
See application file for complete search history.

(56) References Cited

U.S. PATENT DOCUMENTS

| | | | | |
|---|---|---|---|---|
| 5,368,183 | A * | 11/1994 | Singer | 220/528 |
| 5,423,451 | A * | 6/1995 | Snyder | 220/574 |
| 5,865,105 | A * | 2/1999 | Pepelanov | 99/446 |
| 7,326,428 | B2 * | 2/2008 | Weir | 426/120 |
| 7,442,118 | B2 * | 10/2008 | Edmond | 452/196 |
| 2004/0237374 | A1 * | 12/2004 | Klein | 43/21.2 |
| 2005/0039607 | A1 * | 2/2005 | Comfield | 99/324 |
| 2008/0296823 | A1 * | 12/2008 | Pourounidis et al. | 269/289 R |
| 2009/0096150 | A1 * | 4/2009 | Cihan et al. | 269/289 R |
| 2009/0162506 | A1 * | 6/2009 | Weir | 426/396 |
| 2010/0275369 | A1 * | 11/2010 | Eilmus et al. | 4/631 |

FOREIGN PATENT DOCUMENTS

GB 2074846 * 11/1981

* cited by examiner

*Primary Examiner* — Jacob K Ackun
(74) *Attorney, Agent, or Firm* — Ohlandt, Greeley, Ruggiero & Perle, L.L.P.

(57) ABSTRACT

The present disclosure provides a serving assembly that comprises multiple components suitable for different food products, but which connect together easily into one unit. The components can be, in one embodiment, a cutting board, a bowl, and a tray. The tray can have a compartment for storing utensils.

9 Claims, 8 Drawing Sheets

SERVING ASSEMBLY

The present application claims the benefit of U.S. Provisional Patent Application No. 61/466,275, filed on Mar. 22, 2011.

BACKGROUND OF THE DISCLOSURE

1. Field of the Disclosure

The present disclosure relates to a serving assembly. More particularly, the present disclosure relates to a multi-functional serving assembly that has components for displaying, storing, and cutting food products.

2. Discussion of the Related Art

Serving trays or platters can be useful when entertaining groups of people, to present or display food products. However, many currently available platters are very limited in their functionality—they can typically store only one kind of food (e.g., breads, crackers, or dips). This requires users to purchase and store multiple platters or trays for different kinds of food, and the appropriate utensils for the same, which can be very inconvenient.

Accordingly, there is a need to address these and other disadvantages of currently available serving platters or devices.

SUMMARY OF THE DISCLOSURE

The present disclosure provides a serving assembly that can comprise a combination of a cutting board, bowl, and tray. The cutting board, bowl, and tray can all assemble into one component, for ease of use and storage. There can also be a compartment within the assembly for storage of items such as utensils.

Thus, the present disclosure provides an assembly for serving food products, comprising a first component, a second component, and a third component, each of which is removably connected to each other, to form the assembly. The first component can be a planar cutting board, the second component a bowl, and the third component a tray having a channel along an outer portion thereof. The tray can have a compartment at a center portion thereof, the compartment defined by a raised wall.

DETAILED DESCRIPTION OF THE DISCLOSURE

Figure 1:
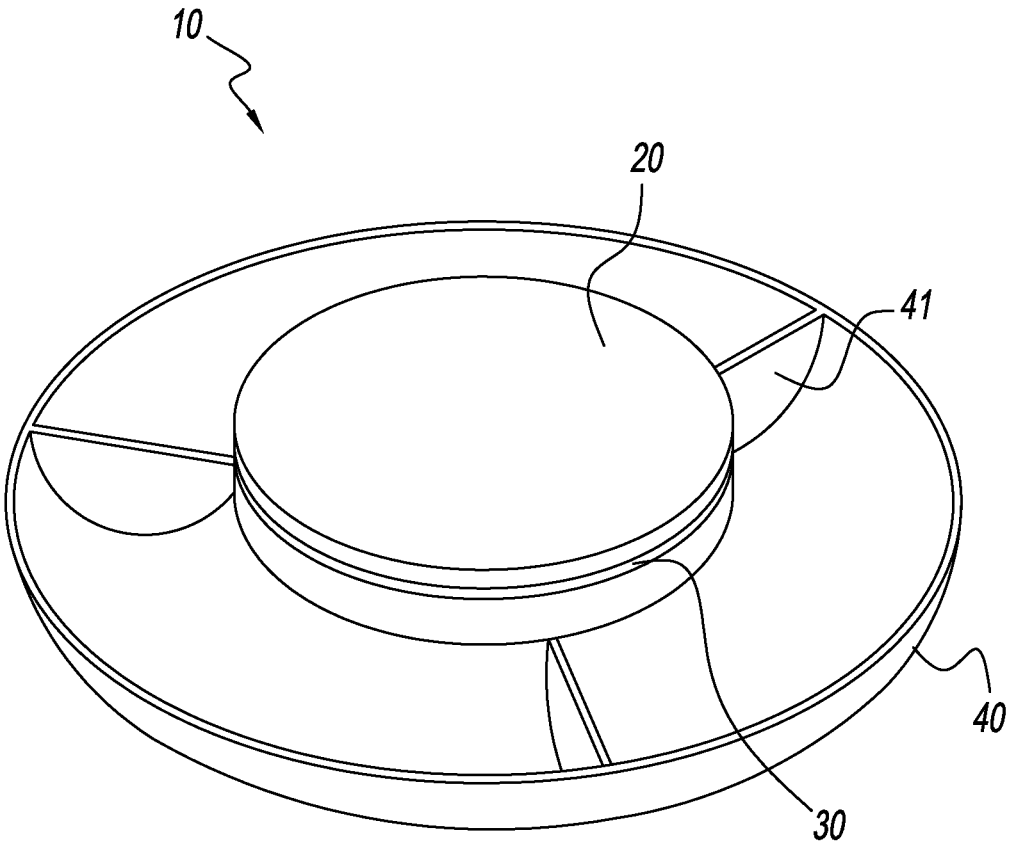
FIG. 1 shows a top, perspective view of the assembled serving assembly of the present disclosure.
Figure 2:
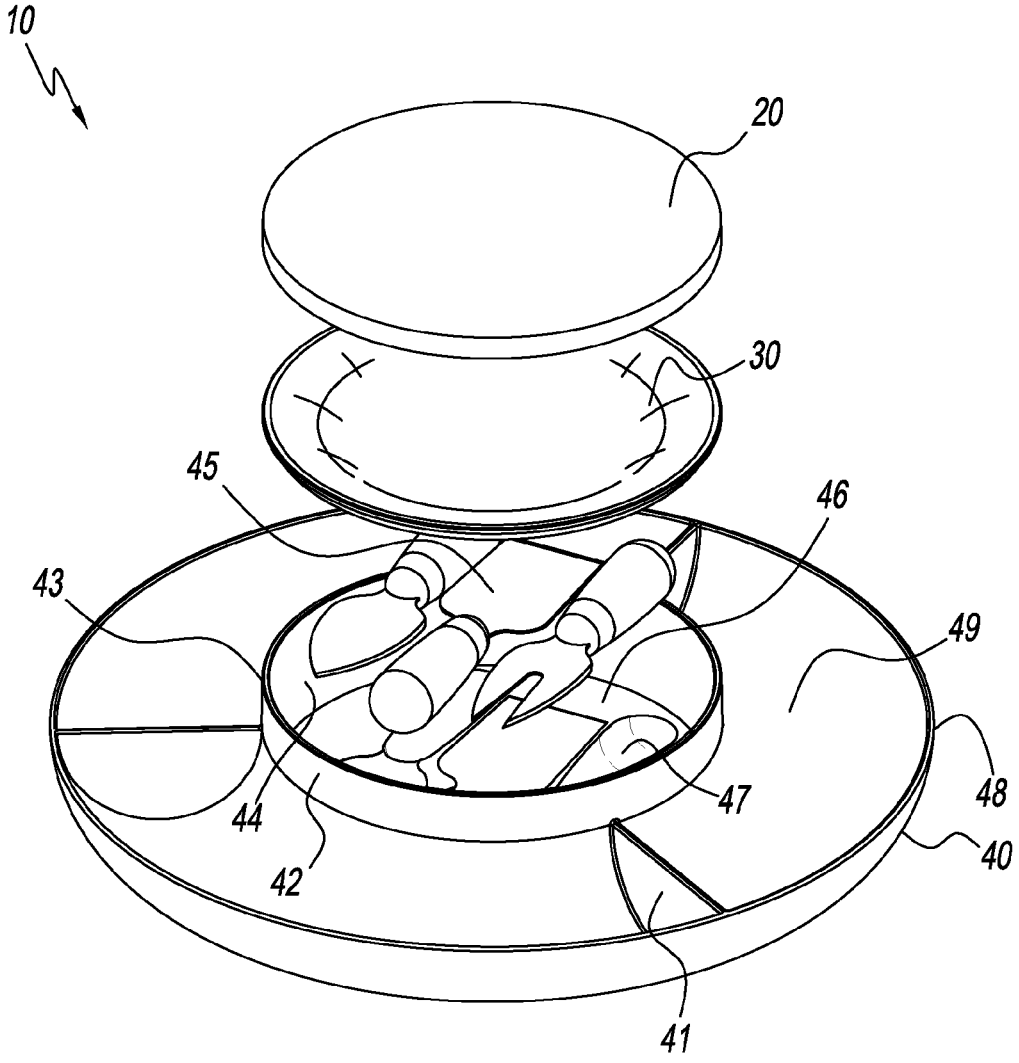
FIG. 2 shows an exploded view of the serving assembly of FIG. 1.
Figure 3:
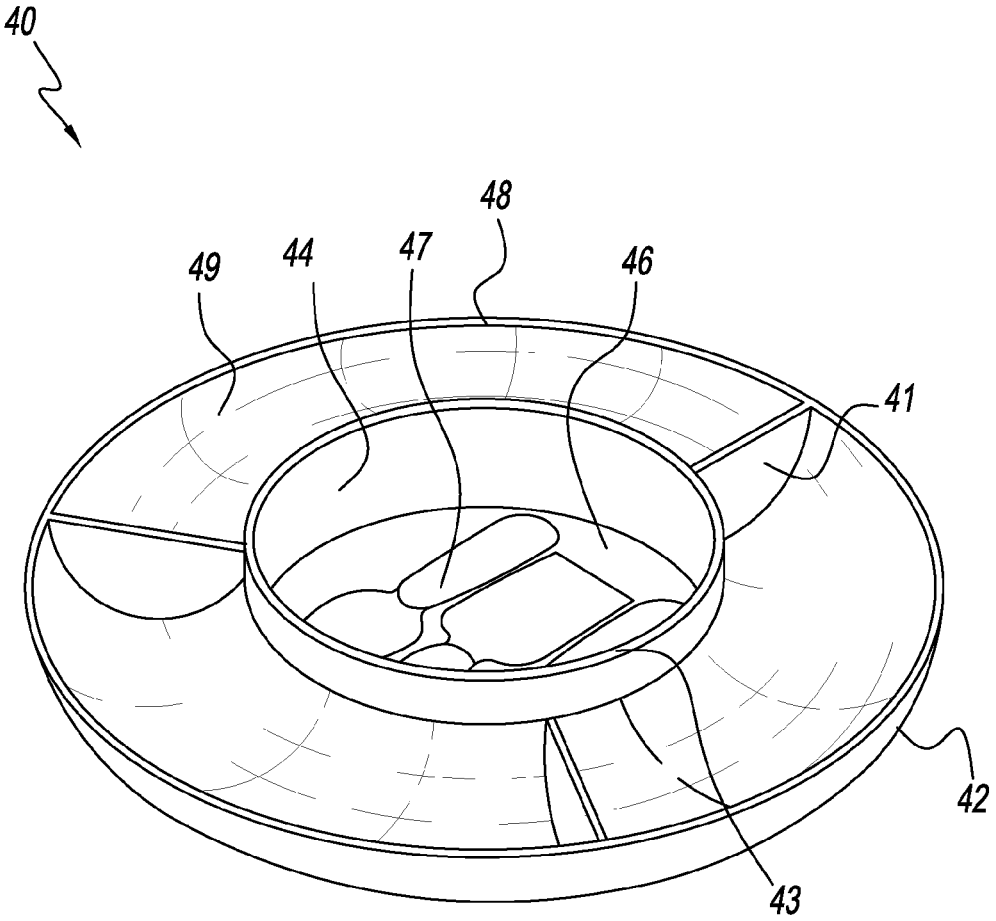
FIG. 3 shows a top, perspective view of the tray of the serving assembly of FIG. 1.
Figure 4:
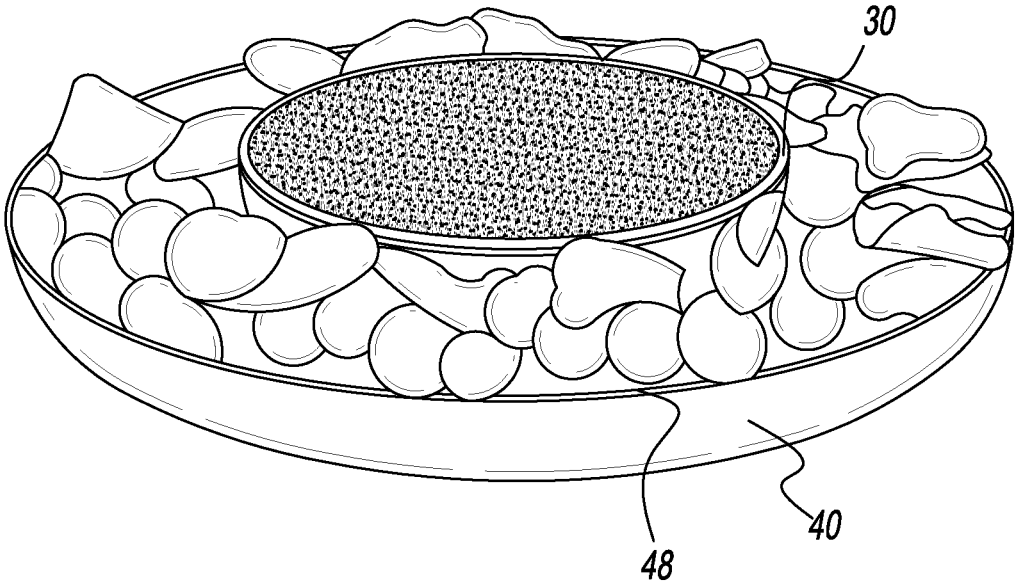
FIG. 4 shows a top, perspective view of the bowl and tray of the serving assembly of FIG. 1 with food products stored therein.
Figure 5:
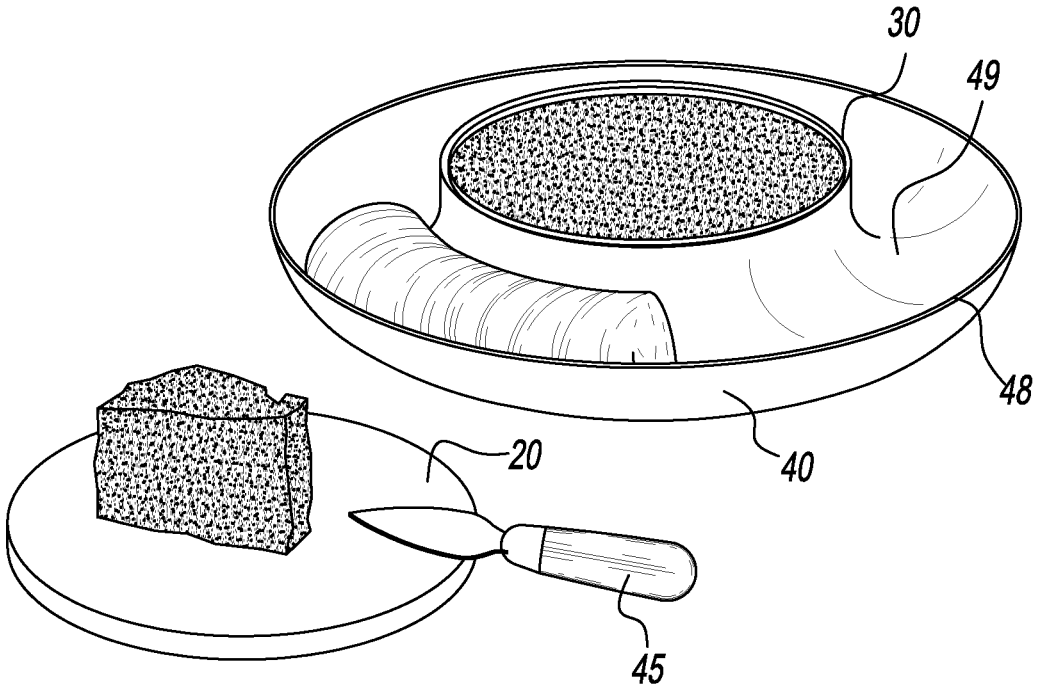
FIG. 5 shows a top, perspective view of the cutting board, bowl, and tray of the serving assembly of FIG. 1 with food products stored thereon and therein.

Referring to the drawings, and in particular FIG. 1, serving assembly 10 is shown, and comprises cutting board 20, bowl 30, and tray 40. Serving assembly 10 can be assembled in the manner shown, by placing cutting board 20 on top of bowl 30, and on top of tray 40. Cutting board 20 can have food products placed thereon which can be cut or sliced (as shown in FIGS. 4 and 5). Bowl 30 can have food products stored therein, such as liquids, semi-liquids such as dip (FIG. 5), or solids (FIG. 4). Tray 40 can display a variety of food products, for example as shown in FIG. 5. Thus, serving assembly 10 provides for the easy and convenient use of many different types of serving devices, yet is assembled into one component that can be easily stored.

As shown in FIGS. 1-5, tray 40 can have a central portion 42 with a raised edge 43. Raised edge 43 forms a compartment 44, in which items such as serving utensils 45 can be stored. Compartment 44 can have a bottom surface 46 which can have a number of depressions 47, to keep utensils 45 secure in place. Bowl 30 can fit over compartment 44 by engaging with raised edge 43. Thus, serving assembly 10 has the additional functionality of storing utensils therein, as compared to keeping them in separate locations. Tray 40 can also have lip 48, so that food items can be stored within channel 49, i.e. between outer edge 48 and central portion 42. Channel 49 can have one or more optional dividers 41 located therein, which can separate the space in channel 49 into two or more separate storage areas for food products. Dividers 41, when used, can be removable.

Cutting board 20, bowl 30, and tray 40 can be connected by simply laying them on top of one another. Other connections can be used, such as with a friction or snap fit. The materials used for each of cutting board 20, bowl 30, and tray 40 are any that are suitable for contact with food, such as wood, plastic, or metal (e.g., stainless steel). In one embodiment, the blade portions of utensils 45 may be chrome-plated plastic.

Utensils 45 can have a variety of shapes, suitable for cutting and serving different food products. In the shown example, one of utensils 45 is a fork, another has a generally rectangular blade for cutting soft cheeses, and a third has a pointed or spade shape for cutting hard cheeses.

Figure 6:
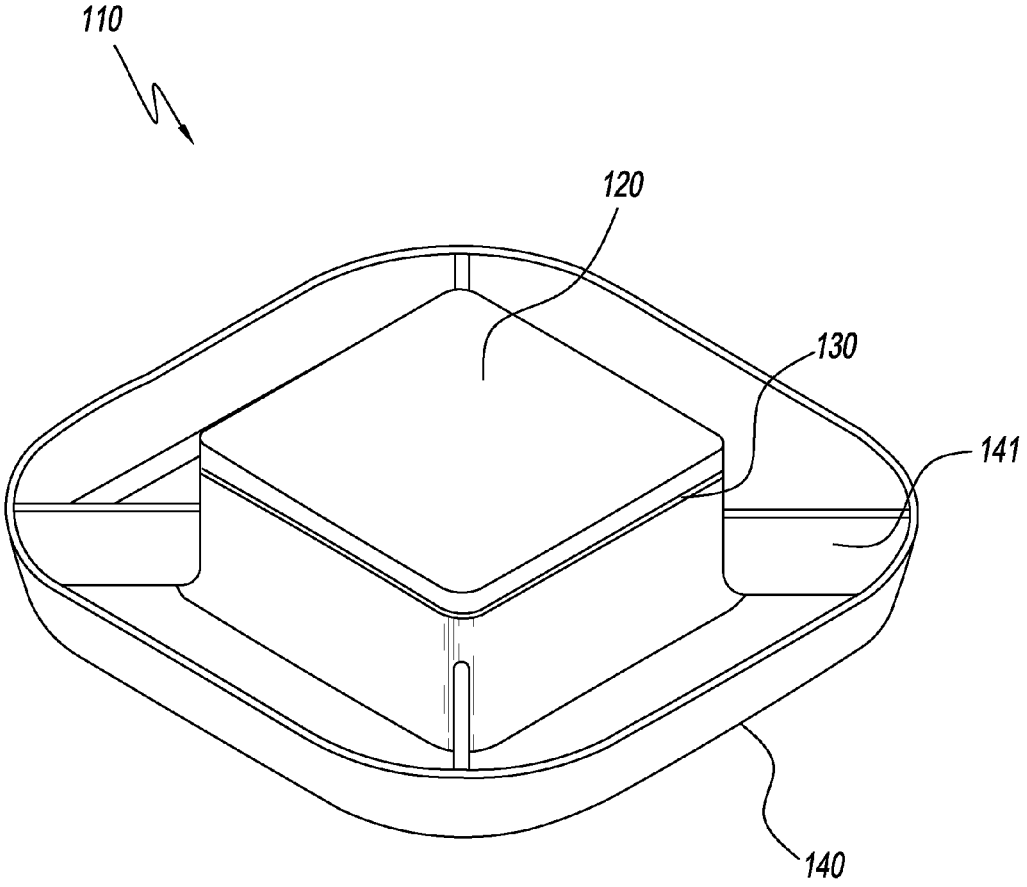
FIG. 6 shows a top, perspective view of a second embodiment of the assembled serving assembly of the present disclosure.
Figure 7:
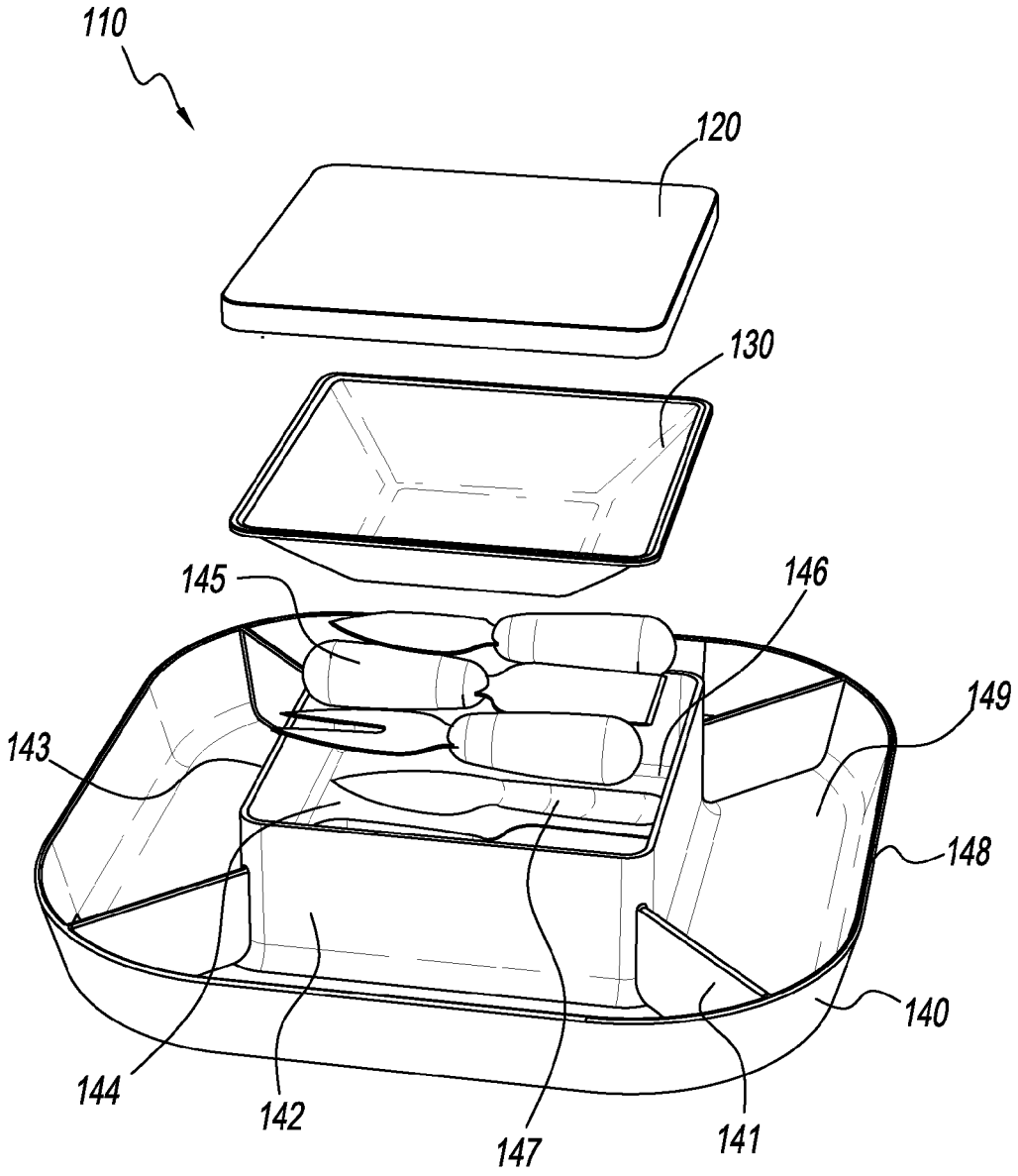
FIG. 7 shows an exploded view of the serving assembly of FIG. 6.
Figure 8:
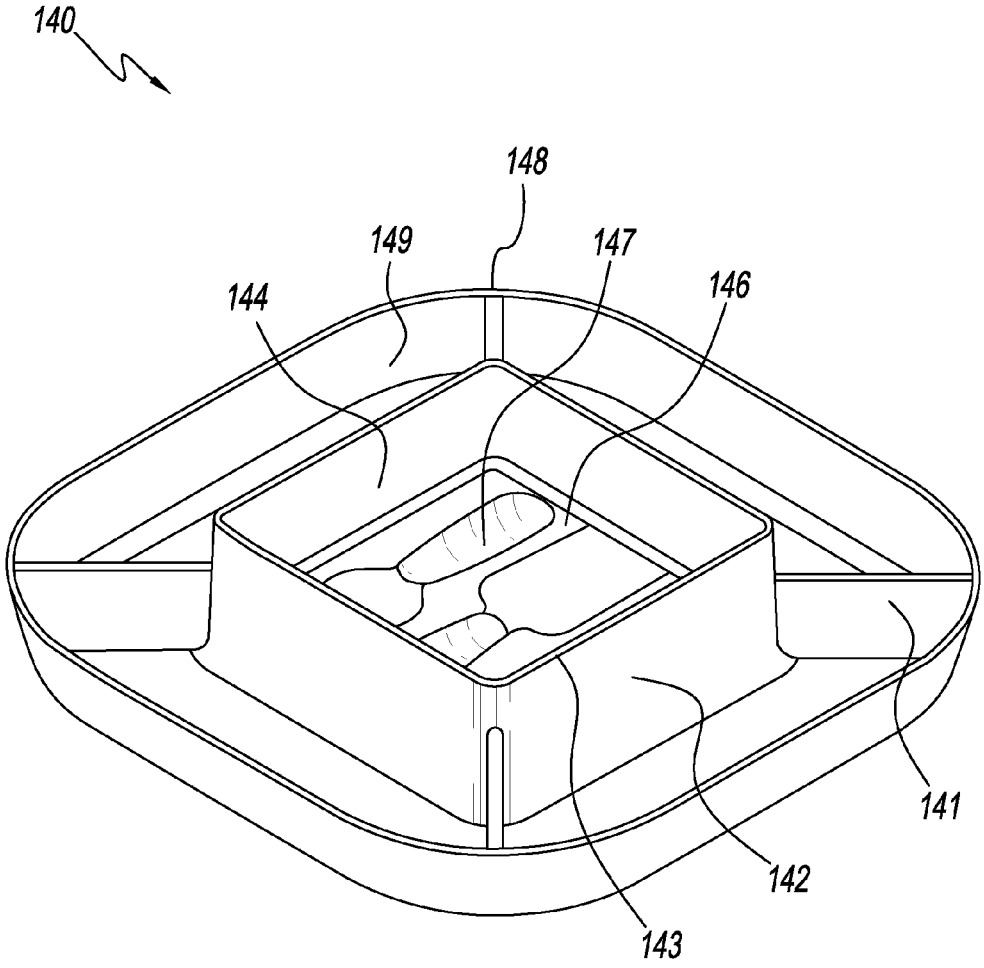
FIG. 8 shows a top, perspective view of the tray of the serving assembly of FIG. 6.

Referring to FIGS. 6-8, a second embodiment of the serving assembly of the present disclosure is shown, and is referred to by numeral 110. Serving assembly 110 has similar features to those of serving assembly 10, with the exception that assembly 110 is generally square, with rounded corners, where assembly 10 was round or circular. Thus, assembly 110 has cutting board 120, bowl 130, and tray 140. As shown in FIGS. 7 and 8, tray 140 can have dividers 141, a central portion 142, raised edge 143, compartment 144, serving utensils 145, bottom surface 146, depressions 147, lip 148, and channel 149. The components in assembly 110 function in a similar manner to similarly-numbered features in assembly 10.

The dimensions of assemblies 10 and 110 are not limited and may be any suitable for the uses described therein. In one embodiment, tray 40 may have a diameter of three-hundred-thirty millimeters (mm) or less, or any subranges thereof, and compartment 44 may have a diameter of one-hundred-seventy millimeters or less, or any subrangers thereof. Bowl 30 and cutting board 20 have diameters matching that of compartment 44, or slightly less, to facilitate connection therebetween.

Although assemblies 10 and 110 are described as having a tray, bowl, and cutting board, different combinations of serving devices are contemplated by the present disclosure, so long as they are easily assembled in the manner described above. For example, bowl 30 or 130 may be a second cutting board, or cutting boards 20 or 120 may be an additional bowl. Trays 40 or 140 may be flat trays without channels 49 or 149, though they would still have central portions to which the other components could be connected.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. An assembly for serving food products, comprising:

a planar cutting board;

a bowl;

a tray having a center portion, an outer lip, and a raised edge at said center portion that defines a compartment;

a channel in said tray, between said raised edge at said center portion and said outer lip; and one or more serving utensils within said compartment, wherein said compartment has a bottom surface with one or more depressions therein, said depressions conforming to said one or more serving utensils, wherein said cutting board is removably connected to said bowl, and said bowl is removably connected to said raised edge, to form the assembly.

2. The assembly of claim 1, wherein said cutting board, said bowl, and said tray connect to each other in a vertical alignment, so that said cutting board is on top of said bowl, and said bowl is on top of said tray.

3. The assembly of claim 1, wherein each of said cutting board, said bowl, and said tray are circular.

4. The assembly of claim 1, wherein each of said cutting board, said bowl, and said tray are rectangular.

5. The assembly of claim 1, wherein said channel has at least one divider therein.

6. The assembly of claim 1, wherein said bowl is removably connected to said raised edge of said tray.

7. The assembly of claim 3, wherein said cutting board and said bowl have equal diameters.

8. The assembly of claim 1, wherein said planar cutting board, said bowl, and said tray are connected to one another with a snap-fit connection.

9. The assembly of claim 1, wherein said planar cutting board, said bowl, and said tray are connected to one another with a friction fit connection.

* * * * *